US008596303B1

(12) United States Patent
Ballenger

(10) Patent No.: US 8,596,303 B1
(45) Date of Patent: Dec. 3, 2013

(54) SUPPLEMENTARY BEATER FOR A HANDLOOM

(76) Inventor: Susan B. Ballenger, Peace Dale, RI (US)

( * ) Notice: Subject to any disclaimer, the term of this patent is extended or adjusted under 35 U.S.C. 154(b) by 0 days.

(21) Appl. No.: 13/347,845

(22) Filed: Jan. 11, 2012

(51) Int. Cl.
*D03D 49/68* (2006.01)
*D03J 3/00* (2006.01)

(52) U.S. Cl.
USPC ..... 139/29; 139/380; 139/1 R; 139/35; 139/116.1

(58) Field of Classification Search
USPC ..... 139/380, 189, 191, 1 R, 27, 28–33
See application file for complete search history.

(56) References Cited

U.S. PATENT DOCUMENTS 278,715 A * 6/1883 Macfarlane ..... 139/18
1,449,686 A * 3/1923 Mace ..... 139/192
1,483,495 A * 2/1924 Vishloff ..... 19/115 R
1,609,272 A * 11/1926 Davis ..... 139/2
1,826,314 A * 10/1931 Holmes ..... 139/191
1,858,482 A * 5/1932 Churchill ..... 139/29
1,874,555 A * 8/1932 Lindsjo ..... 139/189
1,888,908 A * 11/1932 Connell ..... 139/33
2,094,505 A * 9/1937 Thackeray ..... 139/33
2,095,576 A * 10/1937 Shimwell ..... 139/188 R
2,098,449 A * 11/1937 Churchill ..... 139/29
2,150,187 A * 3/1939 Raba et al. ..... 139/33
2,166,415 A * 7/1939 Lervad ..... 139/33
2,167,193 A * 7/1939 Wessborg et al. ..... 139/33
2,238,658 A * 4/1941 Pelce et al. ..... 139/457
2,242,210 A * 5/1941 Gallinger ..... 139/33
2,350,167 A * 5/1944 Jones et al. ..... 139/29
2,437,716 A * 3/1948 Tiefenthal ..... 139/33
2,444,162 A * 6/1948 Havice ..... 139/33
2,457,852 A * 1/1949 Tiefenthal ..... 139/33
2,529,456 A * 11/1950 Nichols ..... 139/188 R
2,582,008 A * 1/1952 Clack ..... 139/33
2,636,498 A * 4/1953 Servilla ..... 132/149
2,677,395 A * 5/1954 Harding et al. ..... 139/29
2,798,512 A * 7/1957 Nadeau ..... 139/33
2,799,297 A * 7/1957 Bergstrom et al. ..... 139/191
2,930,410 A * 3/1960 Schraegle ..... 139/30
2,974,686 A * 3/1961 Frentzel ..... 139/29
3,379,223 A * 4/1968 Fend ..... 139/436
3,705,605 A * 12/1972 Titov ..... 139/436
3,739,437 A * 6/1973 Alberici et al. ..... 28/151
3,774,649 A * 11/1973 Glessner ..... 139/33
3,835,870 A * 9/1974 Sick ..... 132/160
3,867,965 A * 2/1975 Hanson ..... 139/33
3,963,059 A * 6/1976 Strauss ..... 139/436
3,965,939 A 6/1976 Kulczycki et al.
3,990,484 A * 11/1976 Steiner ..... 139/436
4,046,171 A * 9/1977 Wilson ..... 139/29
4,074,726 A * 2/1978 Harris ..... 139/29
4,109,685 A * 8/1978 Westin ..... 139/33
4,116,243 A * 9/1978 Vettiger ..... 139/435.1
4,154,267 A * 5/1979 Orr et al. ..... 139/29

(Continued)

*Primary Examiner* — Bobby Muromoto, Jr.
(74) *Attorney, Agent, or Firm* — Salter & Michaelson

(57) ABSTRACT

A supplementary beater used with a handloom for constructing a fabric weave, and an associated method of use thereof. The handloom includes a warp beam, a harness for supporting and controlling warp threads, a reed defining a shed and disposed adjacent to the harness for supporting warp threads, and a shuttle for passing weft threads, one at a time, into the shed. The supplementary beater is adapted for manual insertion into the shed and for the purpose of providing an undulating weft pattern in the fabric weave.

13 Claims, 13 Drawing Sheets

(56) References Cited

U.S. PATENT DOCUMENTS

| | | | | | |
|---|---|---|---|---|---|
| 4,155,378 | A | * | 5/1979 | Senn | 139/1 R |
| 4,178,970 | A | * | 12/1979 | Mueller | 139/30 |
| 4,181,158 | A | * | 1/1980 | Kidd | 139/33 |
| 4,195,670 | A | * | 4/1980 | Orr et al. | 139/192 |
| 4,254,783 | A | * | 3/1981 | Kim | 132/105 |
| 4,291,729 | A | * | 9/1981 | Steiner | 139/28 |
| 4,301,839 | A | * | 11/1981 | Yamaguchi et al. | 139/29 |
| 4,310,030 | A | * | 1/1982 | Yarlovsky | 139/29 |
| 4,319,611 | A | * | 3/1982 | Foltyn et al. | 139/435.6 |
| 4,351,367 | A | * | 9/1982 | McGinley | 139/11 |
| 4,498,501 | A | * | 2/1985 | Steiner | 139/28 |
| 4,545,603 | A | * | 10/1985 | Henes et al. | 281/27.1 |
| 4,556,089 | A | | 12/1985 | Juillard | |
| 4,732,170 | A | * | 3/1988 | Thomas | 132/151 |
| 4,936,355 | A | | 6/1990 | Jankovsky | |
| 5,168,000 | A | * | 12/1992 | Reinhard et al. | 428/193 |
| 5,598,875 | A | * | 2/1997 | Musha et al. | 139/192 |
| 6,148,868 | A | * | 11/2000 | Kawamura et al. | 139/192 |
| 6,213,163 | B1 | * | 4/2001 | Wang | 139/192 |
| 6,523,547 | B1 | * | 2/2003 | Crocilla | 132/139 |
| 6,536,481 | B2 | * | 3/2003 | Wang | 139/192 |
| 2002/0100913 | A1 | * | 8/2002 | Uda et al. | 257/89 |
| 2004/0129287 | A1 | * | 7/2004 | Russell | 132/222 |
| 2005/0241661 | A1 | * | 11/2005 | Eddinger et al. | 132/139 |

* cited by examiner

SUPPLEMENTARY BEATER FOR A HANDLOOM

FIELD OF THE INVENTION

The present invention relates in general to a handloom and pertains, more particularly, to the use of a supplementary beater that is manipulated in association with the weaving procedure.

BACKGROUND OF THE INVENTION

By way of example, reference may be made to U.S. Pat. No. 4,195,670 to Orr et al. for the description of a handloom that is of a type usable with a reed device. As will be described in further detail hereinafter, a reed is a comb-like device through which the warp threads are threaded to maintain the warp threads in a spaced apart relationship. A beater is used for holding the reed and is in the form of a movable frame (beater) which regulates the density of weft. The typical handloom is for creating woven fabrics. For this purpose, the beater is transitioned so as to firmly engage a weft yarn with the warp yarns. However, this normal loom function does not enable any variance in the weft yarn patterns.

Accordingly, it is an object of the present invention to provide a supplementary beater that is adapted for manual insertion into the shed and for the purpose of providing an undulating weft pattern in the fabric weave.

SUMMARY OF THE INVENTION

In accordance with the present invention there is provided a handloom for constructing a fabric weave and that includes a warp beam, a harness for supporting and controlling warp threads, a reed defining a shed and disposed adjacent to the harness for supporting warp threads, and a shuttle for passing weft threads, one at a time, into the shed. The improvement in accordance with the present invention is comprised of a supplementary beater adapted for manual insertion into the shed and for the purpose of providing an undulating weft pattern in the fabric weave.

In accordance with other aspects of the present invention the supplementary beater is elongated, having opposed elongated side edges; one of the side edges has an undulating surface edge; the opposed side edge is straight; the undulating surface extends along a center section of the supplementary beater; the undulating surface edge has straight edges on either side thereof; both edges of the supplementary beater have a pointed cross-section; one of the side edges has a saw tooth shape; one of the side edges has a square tooth shape.

In another version of the present invention there is provided a method of using a handloom for constructing a fabric weave and that includes a warp beam, a harness for supporting and controlling warp threads, a reed defining a shed and disposed adjacent to the harness for supporting warp threads, and a shuttle for passing weft threads, one at a time, into the shed, The method comprises providing a supplementary beater and manually inserting the supplementary beater into the shed and for the purpose of providing an undulating weft pattern in the fabric weave. This method may also include moving the supplementary beater in a direction transverse to the warp thread direction to alter the undulating weft pattern. This method may also include the supplementary beater being automatically controlled to control the undulating weft pattern.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 1:
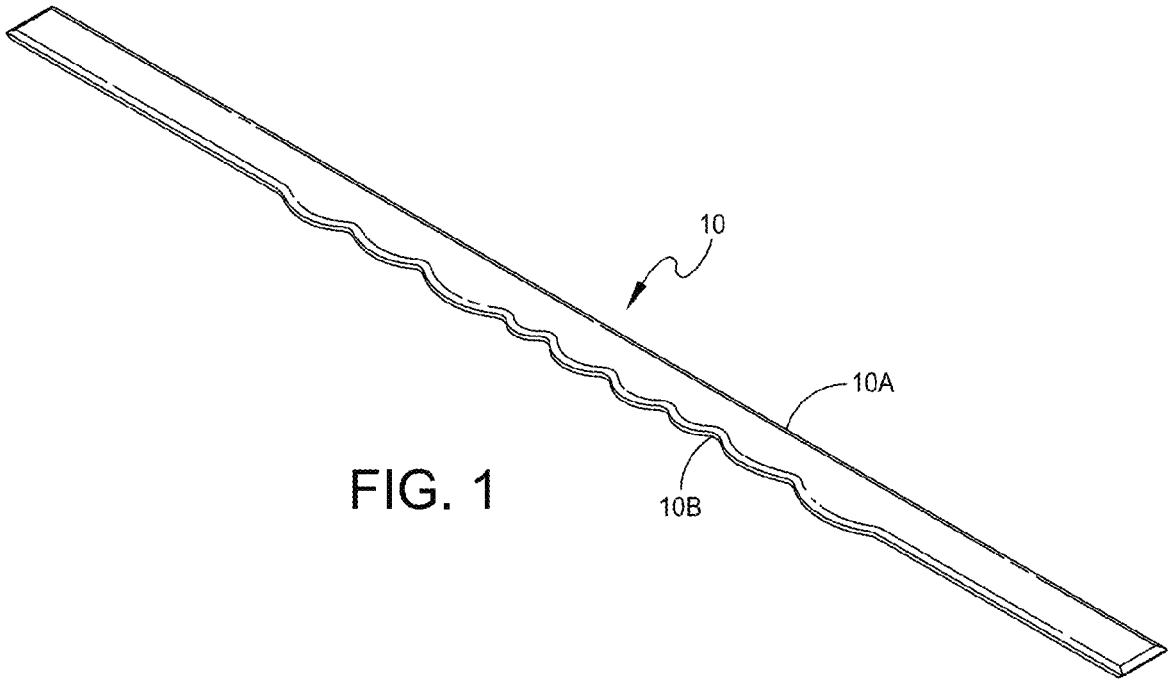
FIG. 1 is a perspective view of a supplementary beater construction in accordance with the principles of the present invention.
Figure 2:
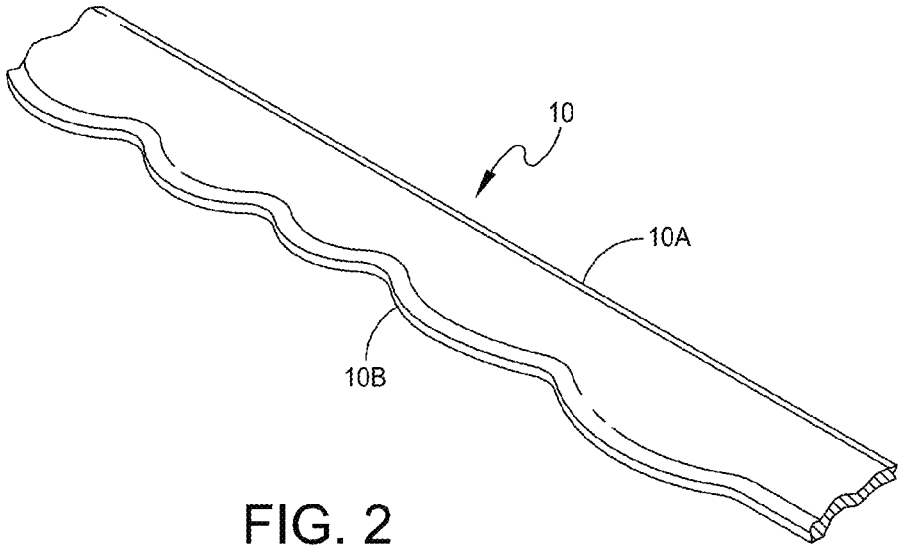
FIG. 2 is a fragmentary perspective view showing the undulating surface of the supplementary beater.
Figure 3:
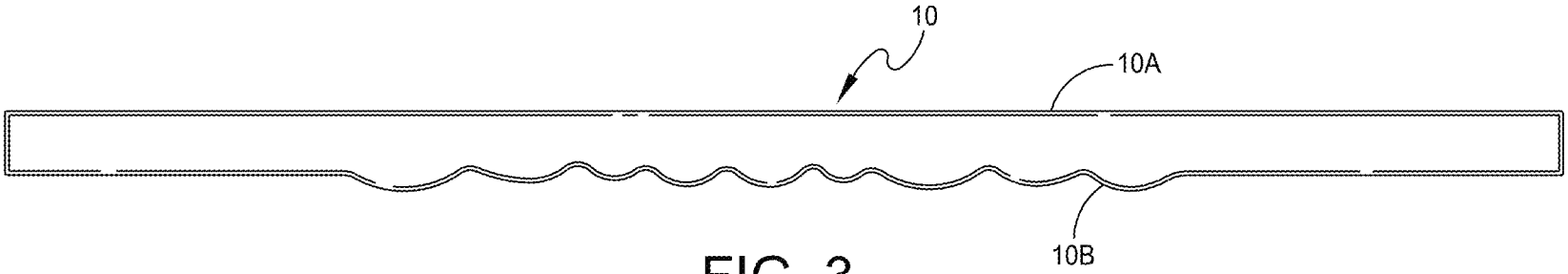
FIG. 3 is a plan view of the supplementary beater.
Figure 4:
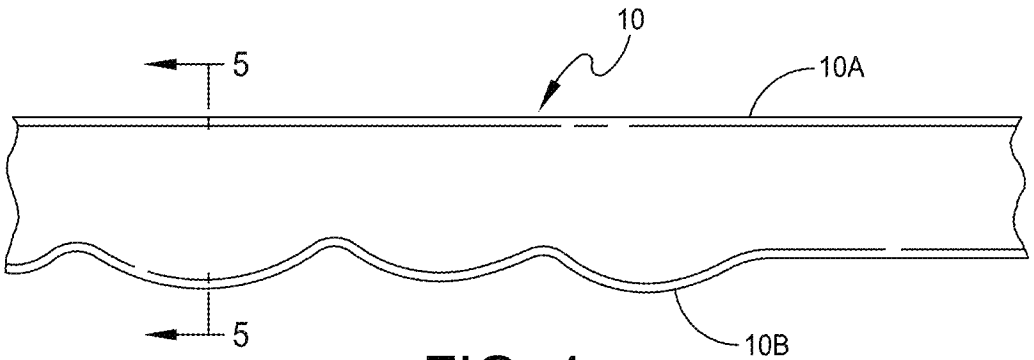
FIG. 4 is an enlarged fragmentary plan view of the supplementary beater.
Figure 5:
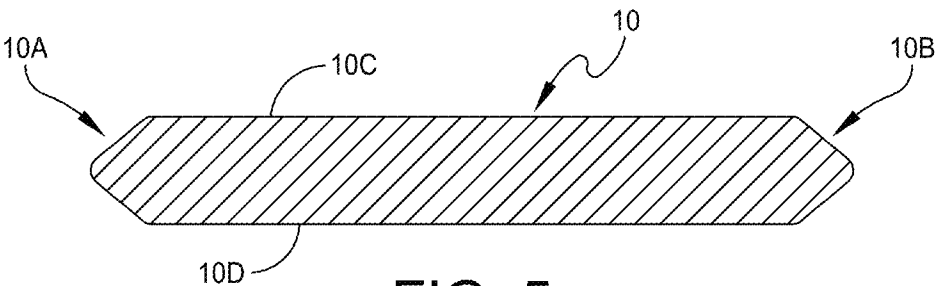
FIG. 5 is a cross-sectional view taken along line 5-5 of FIG. 4.
Figure 6:
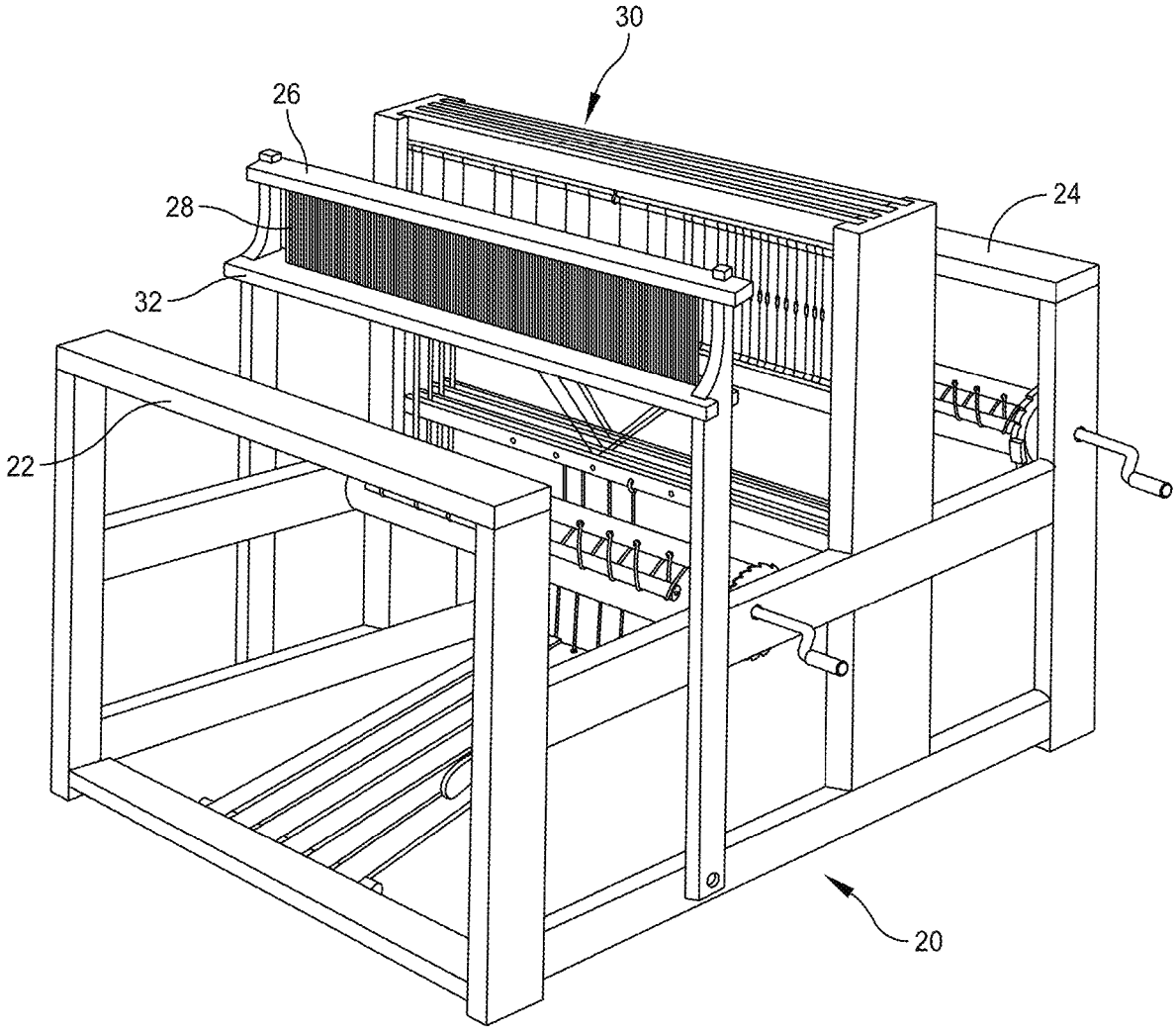
FIG. 6 is a perspective view of a handloom and depicting various components thereof.
Figure 15:
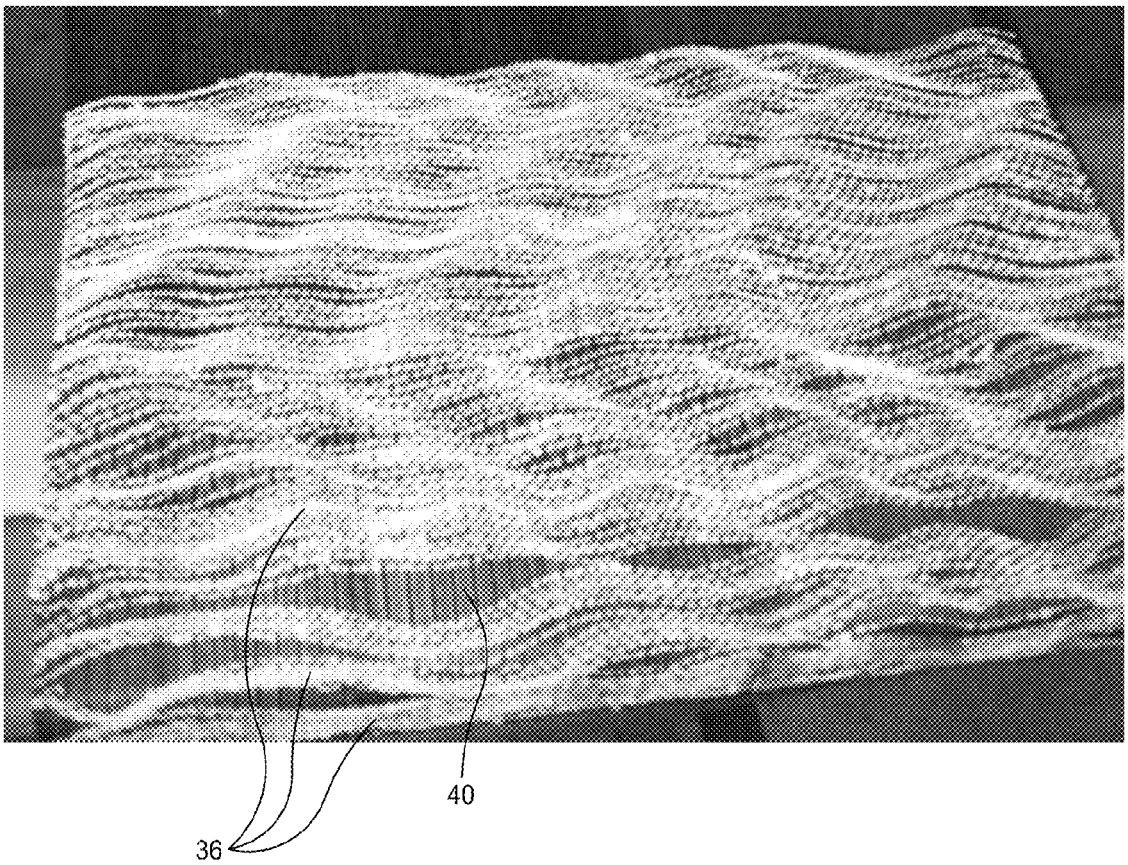
FIG. 15 is a photograph of the weft yarn configuration.

Reference is now made to FIGS. 1-5 of the present application for an illustration of the supplementary beater that is used in the procedure with a handloom such as the one illustrated in FIG. 6 herein. Thus, in FIGS. 1-5 there is illustrated a supplementary beater 10 that is elongated in shape having opposed elongated sides 10A and 10B. The side 10A is substantially straight as illustrated in the drawings while the side 10B has an undulating surface as noted in the drawings. Also, each of these opposed sides are illustrated in the cross-sectional view of FIG. 5 as being somewhat pointed. In addition to the supplementary beater being elongated, it is substantially flat with flat opposed sides 10C and 10D as illustrated in the cross-sectional view of FIG. 5. The supplementary beater illustrated in FIGS. 1-5 may be used to create the weft yarn pattern such as illustrated in FIG. 15 herein.

Figure 16:
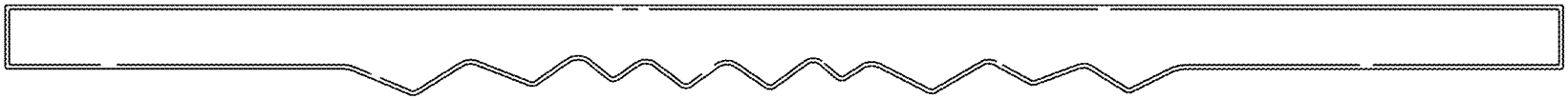
FIGS. 16 and 17 illustrate alternate embodiments of the supplementary beater.
Figure 17:
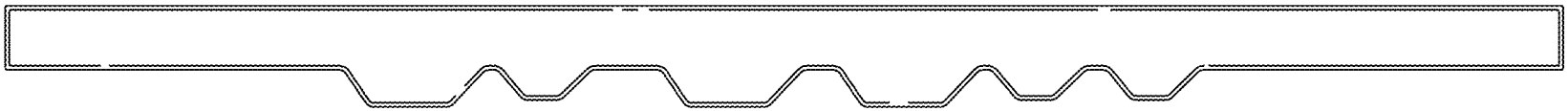

Reference may also be made to alternate supplementary beater configurations as illustrated in FIGS. 16 and 17. FIG. 16 illustrates more of a sawtooth-type undulating pattern. The supplementary beaters illustrated in FIGS. 16 and 17 may be of basically the same constructions as illustrated in FIGS. 1-5 with the exception of the configuration of the undulating surface. In FIG. 17 the undulating surface has a trapezoidal configuration.

Reference is now made to the perspective view of FIG. 6 for an illustration of a handloom. Because the various components of the handloom are well known, the components are not described in great detail herein. The handloom 20 includes, for example, a breast beam 22 at one end and a back beam 24 at the other end; a beater 26 that supports the reed 28; and the harness 30. Associated with the beater 26 is the shuttle race 32. In FIG. 6, for the sake of simplicity, none of the yarns are illustrated. However, reference may now be made to, for example, FIGS. 7 and 8 for an illustration of a portion of the handloom particularly at the beater 26.

The handloom holds the threads, known as warp threads or ends in a taut condition. These warp threads are raised or lowered to form a shed 25, or opening through which the weft, or filler threads is inserted to create an interlacement or fabric. The warp threads are controlled by means of heddles at the harness 30. Thus, the handloom is comprised of a framework to hold warp threads rigid while the weft thread is interlaced.

The beater is a movable frame that holds the reed, which orders the warp yarns and regulates the density of the weft yarns. By pulling the beater forward, it pushes the weft into place against the warp yarns. The beater is attached to either the top or bottom of the loom by a pair of upright battens which allow it to swing freely. After each new pick of weft has been passed through the shed, the beater is normally pulled against the web in such a way that the reed packs the new weft against the previous weft.

The reed 28 is a comb-like device that is parallel to the harnesses and through which the warp ends are threaded after they leave the heddles. The reed is supported by the beater to space the warp ends according to the desired weave. The reed may be provided in a variety of spacings, lengths and heights depending upon the construction of the particular hand loom. The shed is an opening through which the weft is inserted to create interlacement or fabric. The shed is formed by lowering or raising the warp threads.

Figure 7:
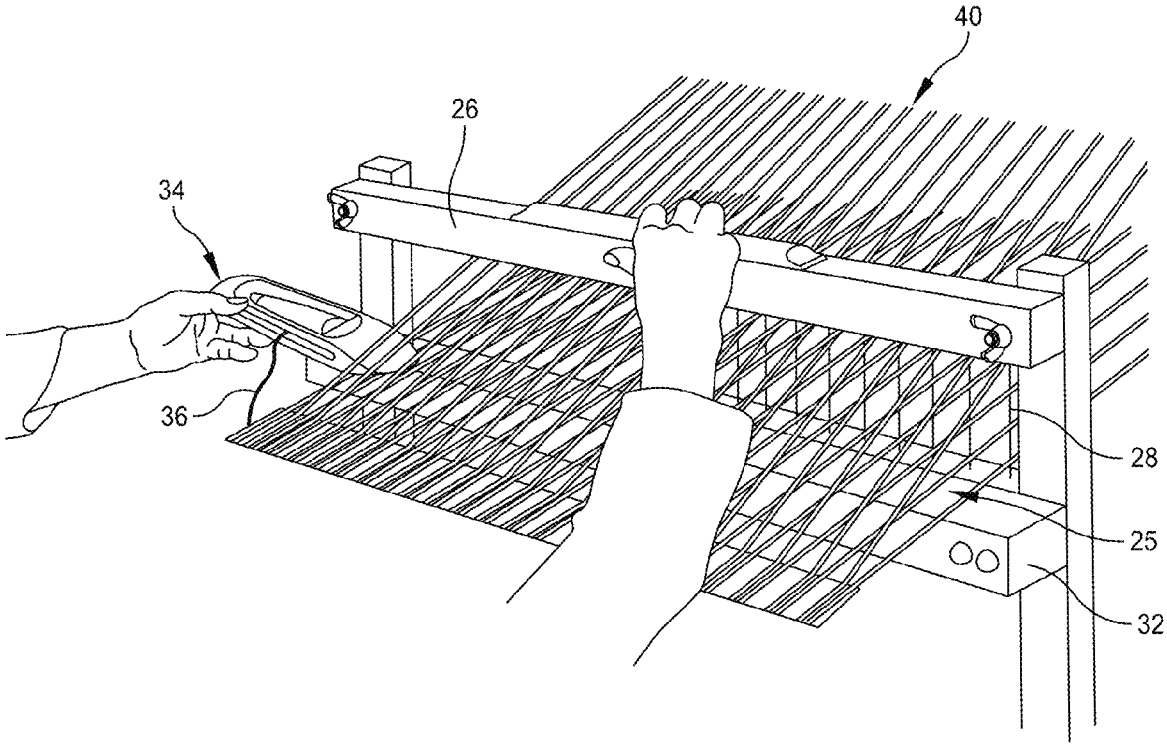
FIG. 7 is a fragmentary perspective view of a portion of the handloom showing the step of inserting the shuttle.
Figure 8:
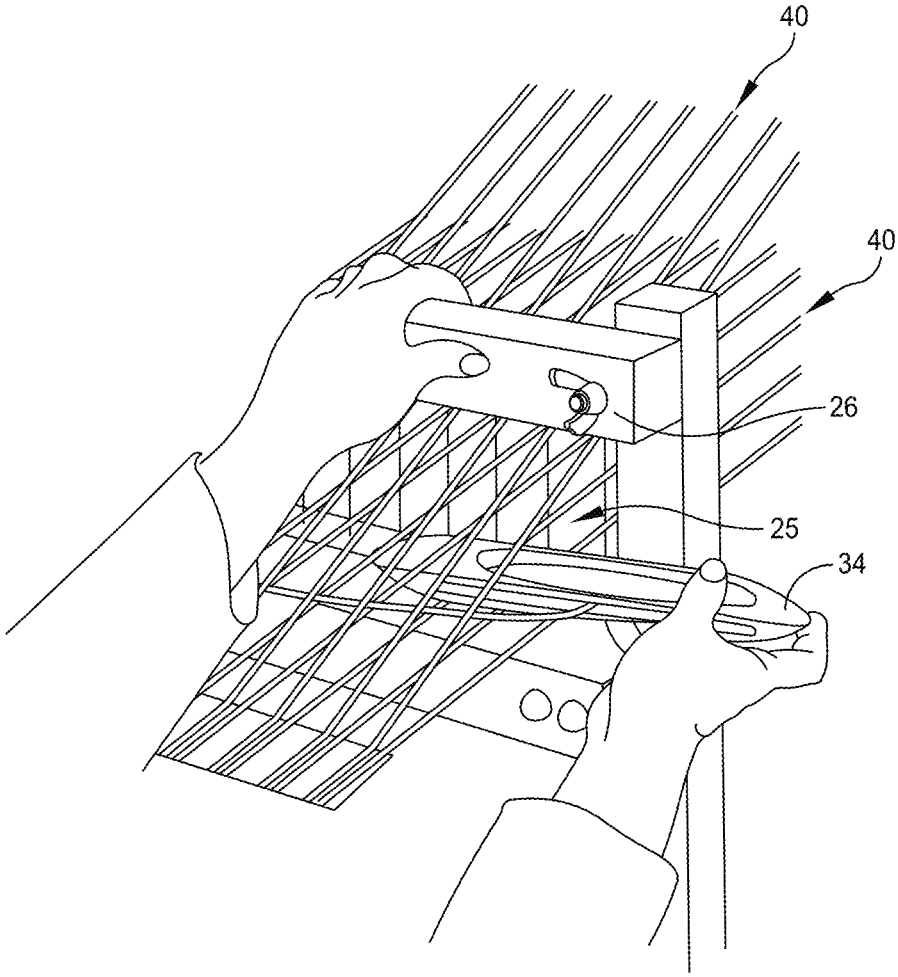
FIG. 8 is a fragmentary perspective view showing a reinsertion of the shuttle.

Reference is now made to the fragmentary perspective view of FIG. 7 which shows the sets of warp threads 40. FIG. 7 also illustrates the beater 26 and the shuttle 34 being held in the hand of the user and supporting a single weft thread 36. FIG. 7 illustrates the shuttle 34 about to be placed into the shed 25 between warp threads. FIG. 8 illustrates the shuttle 34 emerging from the shed 25.

Figure 9:
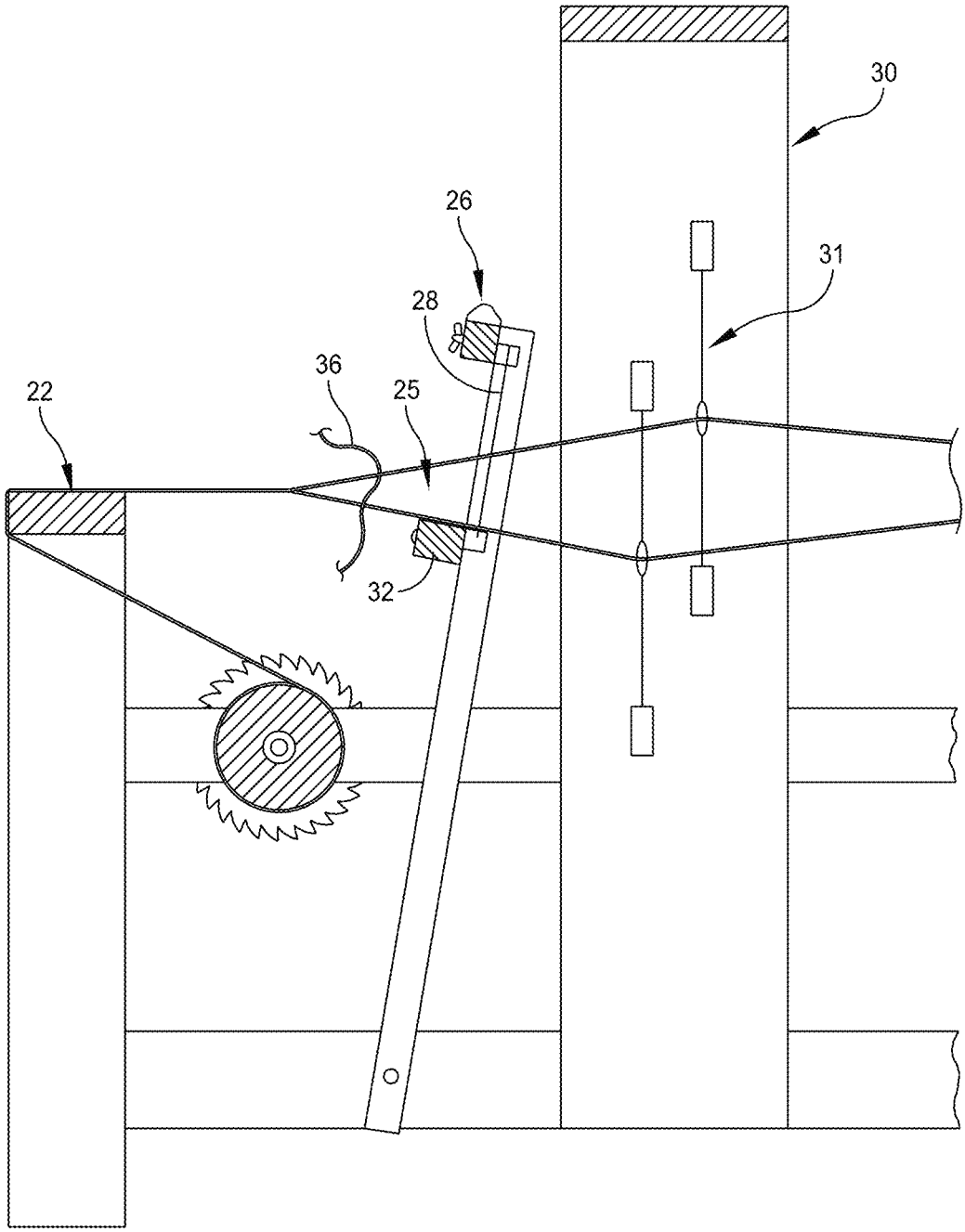
FIG. 9 is a schematic side view of a portion of the handloom illustrating the weft thread being inserted into the shed.
Figure 10:
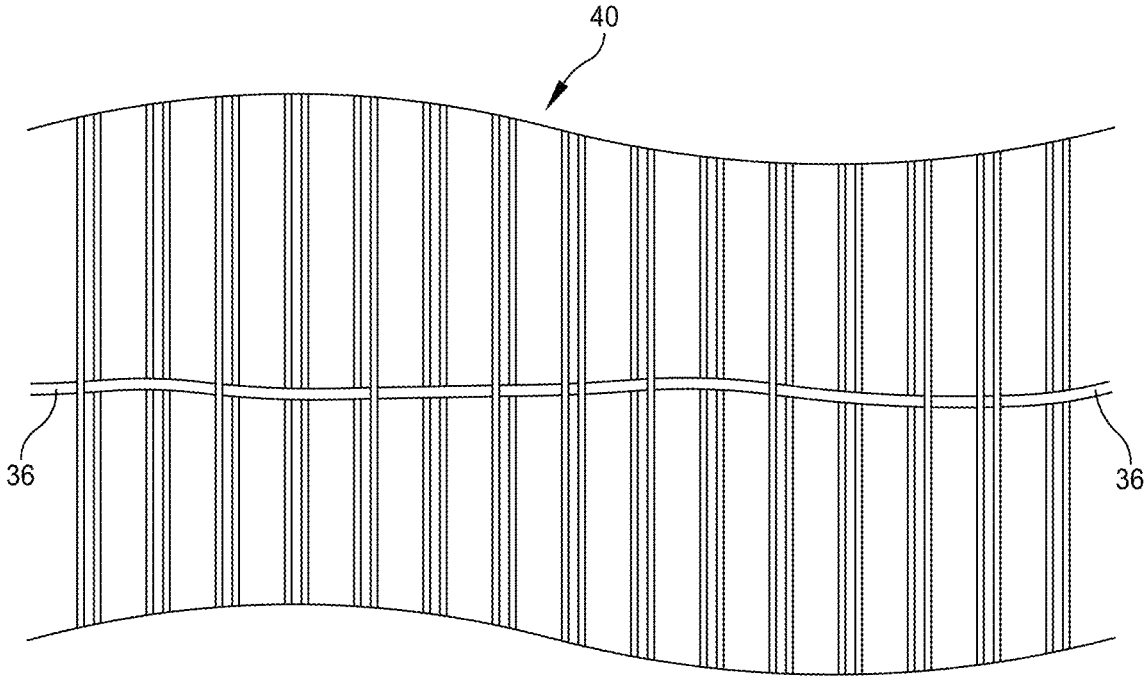
FIG. 10 illustrates a single one of the warp yarns positioned relative to the weft yarns.

Reference is now made to the schematic side view of FIG. 9 which illustrates a portion of the handloom. This illustrates the weft thread 36 disposed within the shed 25 as previously illustrated in FIGS. 7 and 8. FIG. 9 also shows the harness 30 and its supported heddles. Reference may also be made to the plan view of FIG. 10 showing the warp threads at 40 and the interlaced weft thread 36.

Figure 11:
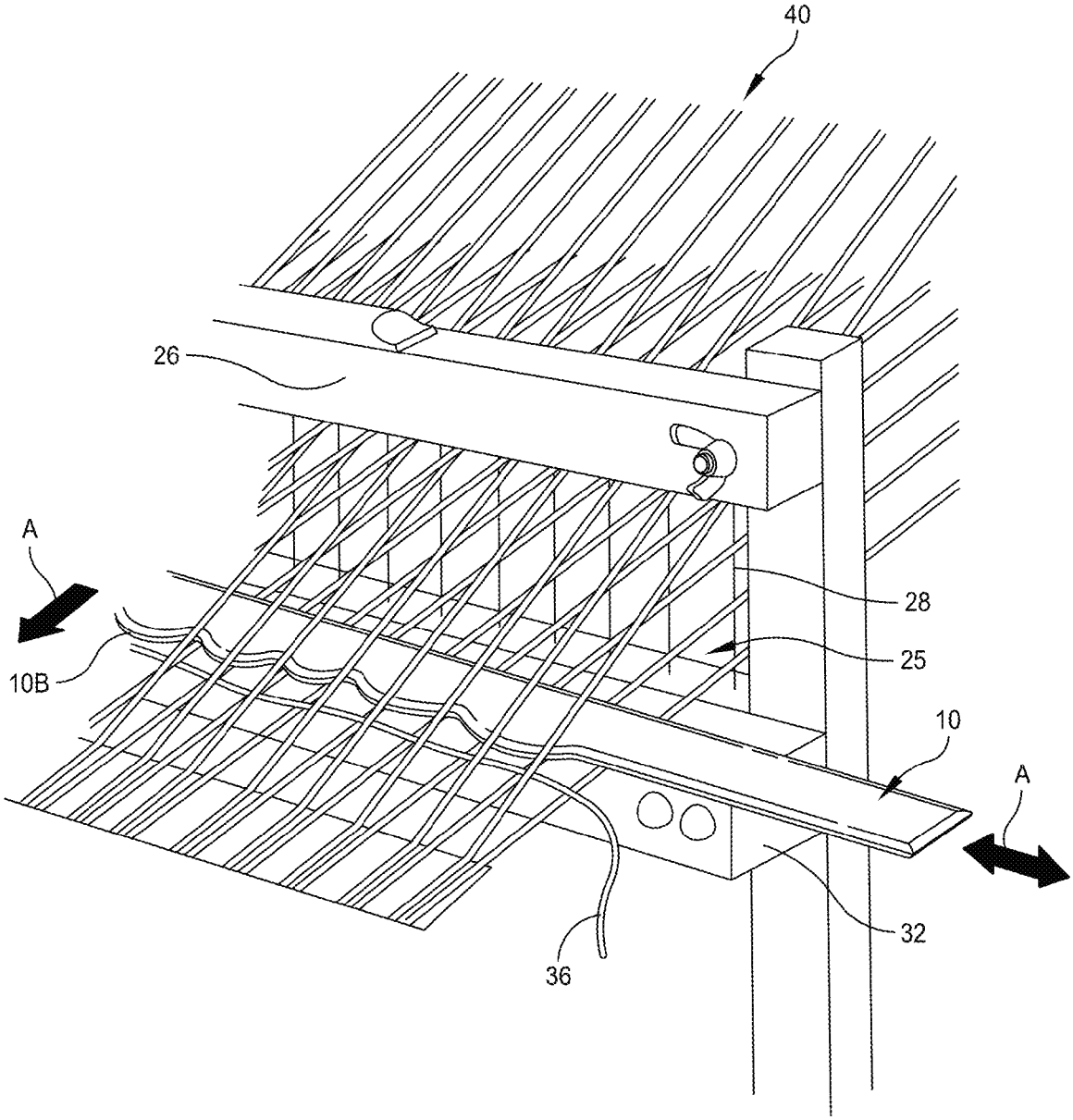
FIG. 11 is a fragmentary perspective view illustrating the use of the supplementary beater of the present invention.
Figure 12:
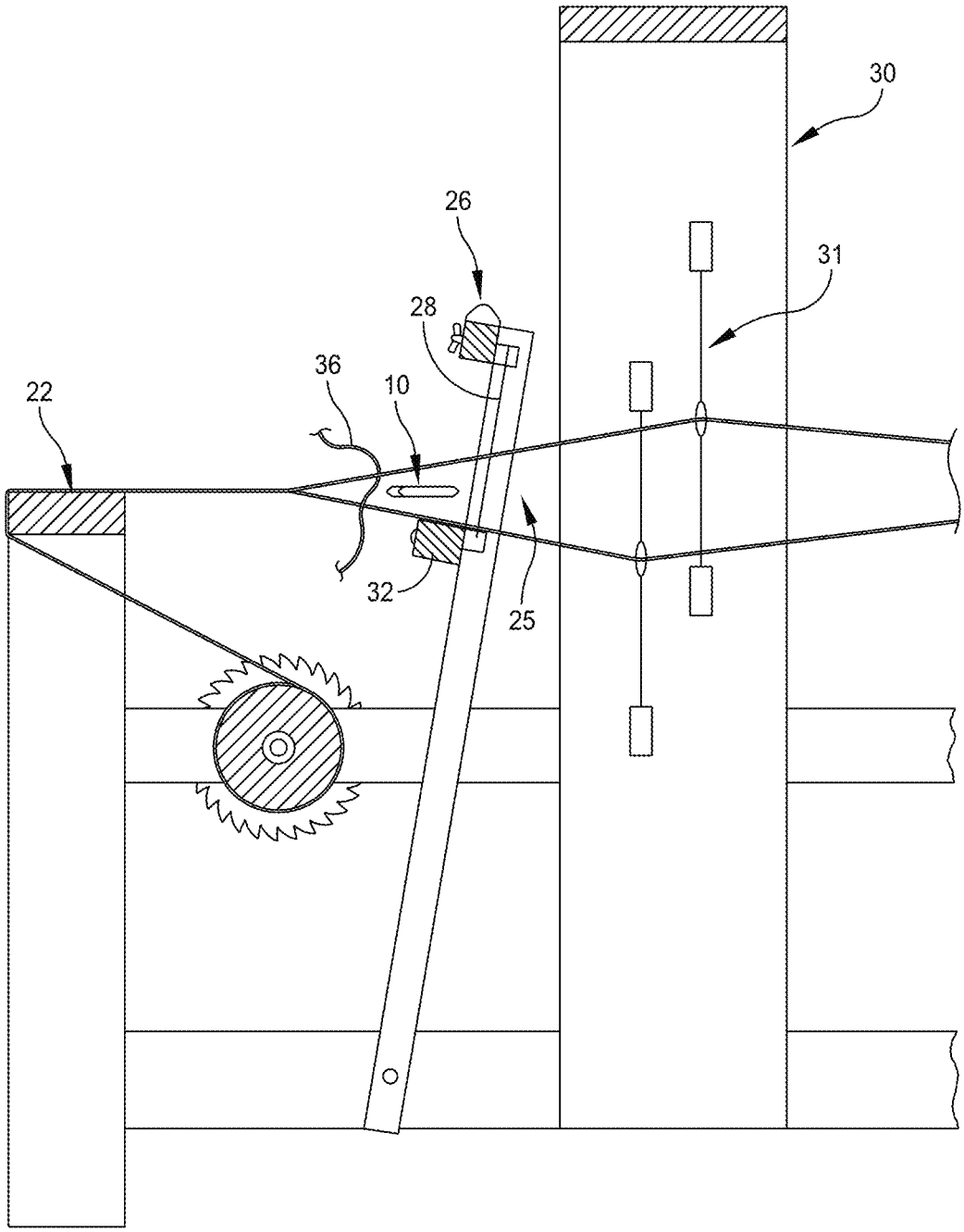
FIG. 12 is a side view similar to that illustrated in FIG. 9 but also illustrating the supplementary beater in position within the shed.

Reference is now made to the fragmentary perspective view of FIG. 11 for an illustration of the use of the supplementary beater 10 previously illustrated in FIGS. 1-5. In FIG. 11, the supplementary beater 10 is illustrated as inserted into the shed 25 between sets of warp threads 40. It is positioned so that the undulating surface 10B faces the previously inserted weft thread 36. FIG. 11 illustrates the supplementary beater 10 about to be moved in the direction of arrow A to engage and position the illustrated weft thread 36. Thus, the supplementary beater 10 can be moved in the direction of arrow A as well as in a transverse manner to the threads 40 such as in the direction of arrow B in order to alter the configuration of the weft thread 36. In this regard refer also to the side schematic view of FIG. 12 that illustrates a position of the supplementary beater 10 relative to the weft thread 36.

Figure 13:
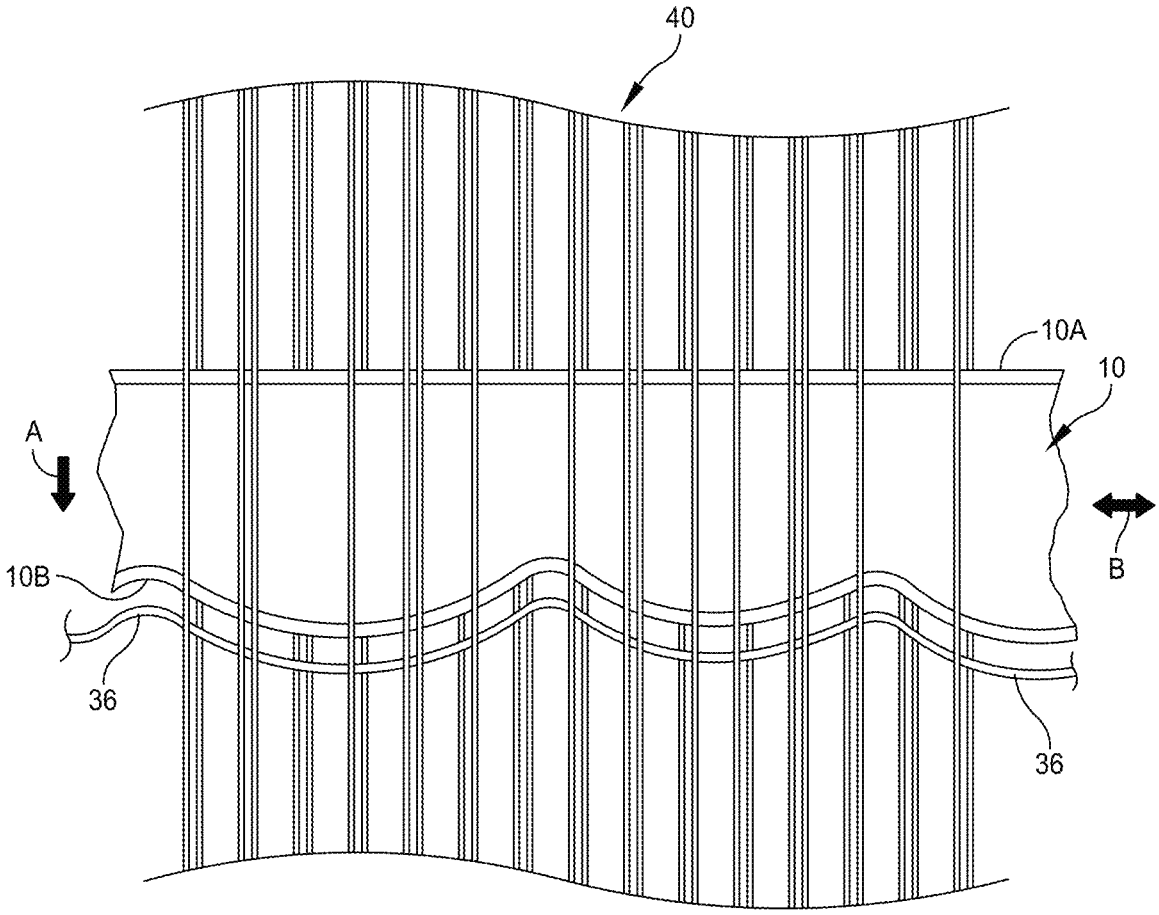
FIG. 13 is a schematic diagram illustrating the supplementary beater in the manner in which it is altering the position of the weft yarn.
Figure 14:
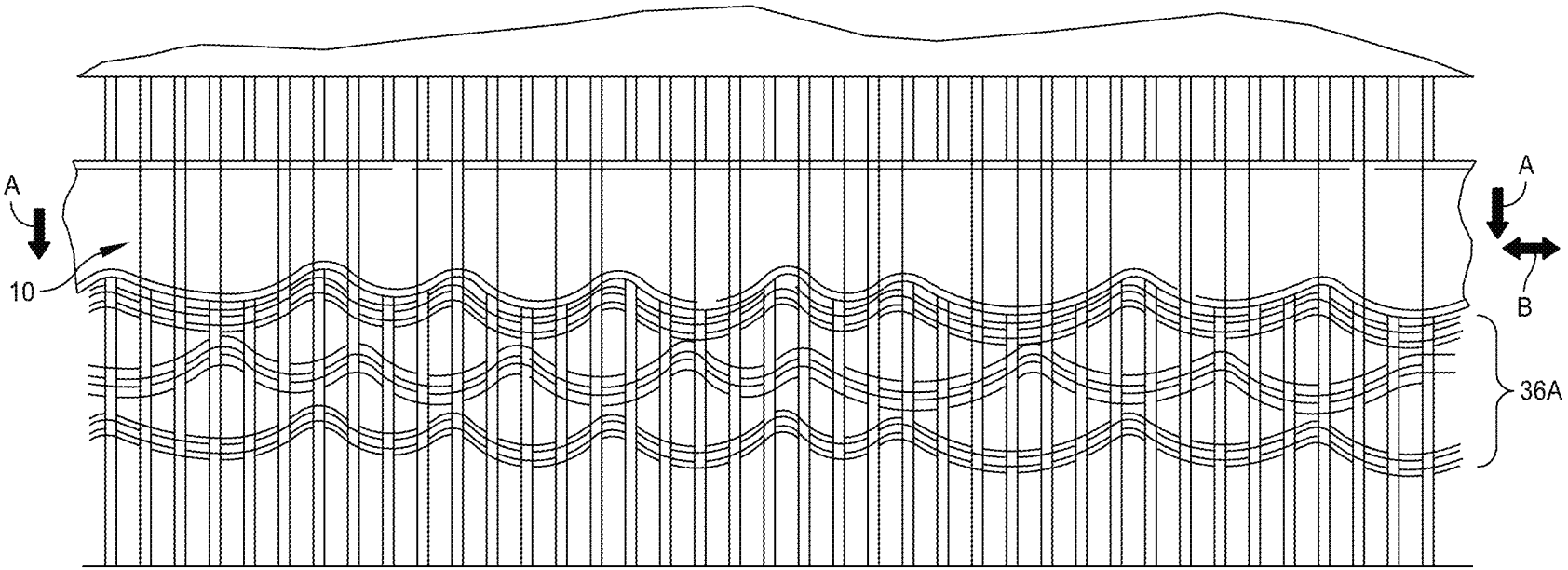
FIG. 14 is a plan view of further steps taken by the supplementary beater to vary the weft yarn patterns.

Reference is now also made to the plan view of FIG. 13 for an illustration of the supplementary beater 10 as moved in the direction of arrow A within the shed 25. FIG. 13 illustrates the undulating surface 10B of the supplementary beater forming an undulation in the thread 36 so that the placement of the thread 36 essentially matches in contour the contour of the undulating surface 10B of the supplementary beater 10. In this regard refer also to the plan view of FIG. 14 that shows the supplementary beater 10 engaging with a weft thread 36. The diagram of FIG. 14 illustrates the manner in which the supplementary beater 10 may be moved both in the direction of arrow A but also possibly transversely in the direction of arrow B so as to alter the undulating pattern. FIG. 14 illustrates a series of weft threads at 36A. It can be seen there that these threads have different undulating configurations which are a function of the particular placement and movement of the supplementary beater 10 as each weft thread is engaged thereby. Refer also to the diagram of FIG. 15 which is a photograph illustrating the various weft threads at 36 and the corresponding warp threads 40. It can be seen from FIG. 15 that the weft threads, as controlled from the manipulation of the supplementary beater, become disposed in different undulating patterns. This provides a totally unique fabric configuration.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. In a handloom for constructing a woven fabric and that includes a warp beam, a harness for supporting and controlling warp threads that extend in a warp thread direction, a reed for spacing the warp threads disposed adjacent to the harness for supporting the warp threads, and a shuttle for passing weft threads that extend in a weft thread direction, said shuttle carrying the weft threads across the warp threads that are either raised or lowered by the harness creating a shed the improvement comprising a supplementary beater adapted for manual insertion into the shed and for the purpose of providing an undulating weft pattern in the woven fabric; wherein the supplementary beater is elongated, having opposed elongated one and other side edges; wherein the one of the side edges has a continuous undulating surface edge facing toward a newly introduced weft thread; wherein the supplementary beater is constructed and arranged so that the undulating surface edge, when the supplementary beater is so inserted into the shed, extends generally in a direction that is substantially orthogonal to the warp thread direction; wherein the undulating surface edge of the supplementary beater has multiple alternating continuous edge peaks and valleys; wherein the undulating surface edge has undulations of different period therealong including at least first undulations of a period greater than the undulations of a second period.

2. The improvement of claim 1 wherein the undulating surface edge of the first period comprises spaced apart undulations on either side of a second period of undulations less in period than the undulations of the first spaced apart undulations.

3. The improvement of claim 2 wherein the peaks and valleys are arranged so that, when the supplementary beater is so inserted into the shed, the peaks are disposed further from the reed than the valleys.

4. The improvement of claim 3 wherein the opposed otic side edge is straight.

5. The improvement of claim 4 wherein the undulating surface extends along a center section of the supplementary beater.

6. The improvement of claim 5 wherein the undulating surface edge has straight edges on either side thereof.

7. The improvement of claim 6 wherein both edges of the supplementary beater have a pointed cross-section.

8. The improvement of claim 2 wherein one of the side edges has a saw tooth shape.

9. The improvement of claim 2 wherein one of the side edges has a square tooth shape.

10. The improvement of claim 1 wherein the supplementary beater is automatically controlled to control the undulating weft pattern.

11. The improvement of claim 1 wherein the supplementary beater is manually controlled to control the undulating weft pattern.

12. The improvement of claim 2 wherein the undulating surface edge extends along a center section of the supplementary beater, and the undulating surface edge has a continuous grooved leading edge.

13. The improvement of claim 6 wherein the undulating surface edge extends along a center section of the supplementary beater, and the undulating surface edge has a continuous grooved leading edge.

* * * * *